United States Patent [19]

Knox, Jr. et al.

[11] Patent Number: 4,735,517

[45] Date of Patent: Apr. 5, 1988

[54] PRINTER HAVING FLUX REGULATOR

[75] Inventors: Richard M. Knox, Jr., Houston; Wm. Michael Miller, Katy, both of Tex.

[73] Assignee: Texas Instruments Incorporated, Dallas, Tex.

[21] Appl. No.: 794,213

[22] Filed: Oct. 31, 1985

[51] Int. Cl.[4] ..... B41J 9/38

[52] U.S. Cl. ..... 400/157.2; 101/93.03; 400/166; 361/152

[58] Field of Search ..... 400/157.2, 157.3, 166, 400/167; 101/93.02, 93.03, 93.29; 361/152

[56] References Cited

U.S. PATENT DOCUMENTS

| | | | |
|---|---|---|---|
| 3,909,687 | 9/1975 | Abbondanti | 318/805 |
| 4,041,361 | 8/1977 | Cornell | 318/432 X |
| 4,273,039 | 6/1981 | Luo | 101/93.02 |
| 4,445,080 | 4/1984 | Curtiss | 318/798 |
| 4,450,427 | 5/1984 | Gareis | 338/32 H |
| 4,548,522 | 10/1985 | Harada | 101/93.05 X |

*Primary Examiner*—Paul T. Sewell

*Attorney, Agent, or Firm*—Thomas G. Devine; James T. Comfort; Melvin Sharp

[57] ABSTRACT

An impact printer has a flux regulator for each of the coils in its printhead. Each regulator provides a reference voltage indicative of the desired flux in the associated coil. A circuit is provided for measuring the flux in the coil and for providing a voltage representative thereof. The measured flux representation is compared with the reference flux representation and any difference is applied to a power circuit which then provides more or less power to the associated coil.

6 Claims, 8 Drawing Sheets

PRINTER HAVING FLUX REGULATOR

BACKGROUND OF THE INVENTION

1. Field of the Invention

This invention relates to regulating the flux in a coil and more specifically to regulation accomplished by comparing the actual flux with the desired flux and changing the actual flux depending upon the difference.

2. Description of the Prior Art

Due to the dynamic magnetic interactions involved in electromechanical devices such as impact printheads in printers, and electric motors, performance of these devices can sometimes be greatly enhanced by regulating the amount of magnetic flux in the device rather than attempting to regulate the voltage or current applied to the device. Since the amount of flux generated is an extremely non-linear function of current or voltage applied, as well as magnetic path reluctance, temperature, and saturation, regulation of simply current or voltage only produces approximations to ideal performance.

In the past, attempts at solving this problem have been made by tightly regulating voltage, current and excitation time, as well as by providing the most practical excitation profiles available to approximate the desired performance. These techniques are both expensive and offer only approximations to ideal results.

BRIEF SUMMARY OF THE INVENTION

This invention regulates the flux present or created in an inductive design (printhead activating coil in this preferred embodiment) by implementing a control regulator whose feedback is the mathematical integral of applied voltage over time scaled by the number of turns in the coil. Since this quantity is the representation of the flux present in the device, the value can be used as the negative feedback to control either a linear or switching regulator which applies power to the device. The value fed back is simply compared to a reference value and the difference is used as an error signal to modify the power applied to the device.

The principal object of this invention is to regulate the flux in a printhead coil by measuring the flux present in the coil, comparing it with a desired flux and adjusting to the value of the desired flux.

Another object of this invention is to regulate the flux in an inductive load by measuring the flux in the inductive load, comparing it against a desired flux and adjusting to the desired flux.

Still another object of this invention is to enable flux regulation of individual coils in a printhead by adjusting the flux in each coil to a desired value singly, or simultaneously with the other coils.

These and other objects will be made evident in the detailed description that follows.

DETAILED DESCRIPTION OF THE INVENTION

The flux regulator of this invention permits instantaneous changing of the flux in a coil by comparing the flux in that coil with a desired flux and instantly changing the power to the coil as indicated by the difference. This invention is particularly useful in applications where the flux in one coil may be affected by the flux in neighboring coils as in an impact type printhead. As more coils are selected to print a given character, the flux in the remaining coils is affected and should be changed to the proper flux for best operation. Coils may be deactivated while others are activated, also requiring immediate recovery to the desired flux for those coils remaining selected. The same problem exists in many electric motors, particularly in stepper motors where coils may be selected independently or concurrently, and in solenoids. This invention, of course, anticipates use in motors and solenoids.

Figure 1:
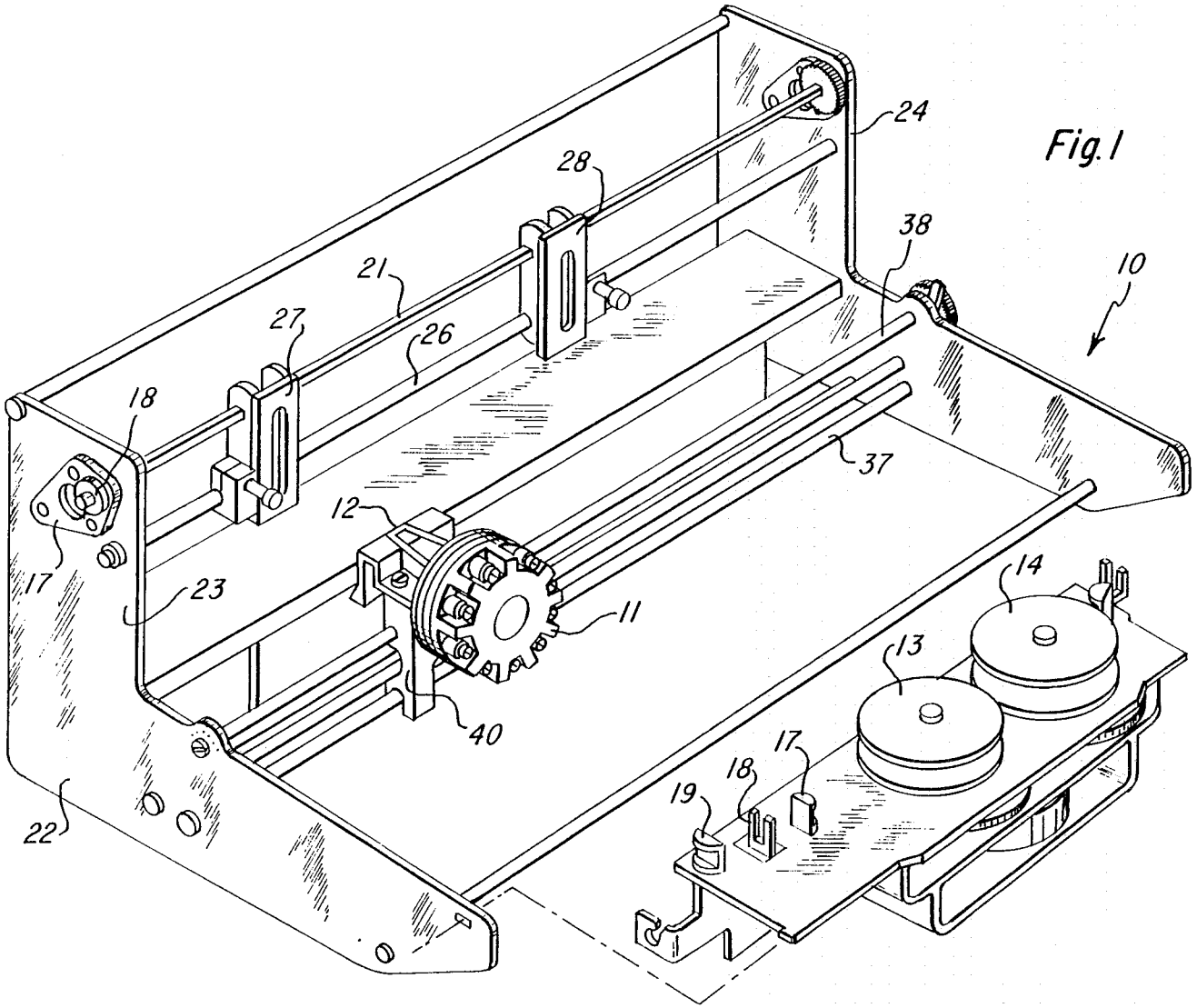
FIG. 1 is a partially exploded view of the section of an impact printer in which the printhead having the activation coils is shown in position.

The impact printer of this invention may be a Model TI855 manufactured by Texas Instruments Incorporated. The combination with a stored energy printhead provides a high speed printer as shown in FIG. 1. FIG. 1 illustrates the inner framework assembly 10 of the wire matrix impact printer which may be used with the flux regulator of this invention. The stored energy wire matrix printhead 11, having an impact end 12, is shown as it is attached to carriage assembly 40. Carriage assembly 40 is shown attached to guide shafts 37 and 38. The carriage assembly 40 is moved from left to right and from right to left by an electric motor (not shown). Print ribbon reels 13 and 14 are shown as they are mounted in position.

Sidewall 22 has bracket assembly 17 mounted to its outer face 23. A similar bracket is attached to sidewall 24. The bracketing and associated drive shaft gear and bearing assembly is fully described in U.S. Pat. No. 4,115,014, assigned to the assignee of this invention. Drive shaft 21 is shown in place upon which are mounted tractors 27 and 28. The printhead of this invention is fully described and claimed in U.S. Pat. No. 4,498,791—"Printer Having Improved Stored Energy Printhead", assigned to the assignee of this invention.

Figure 2:
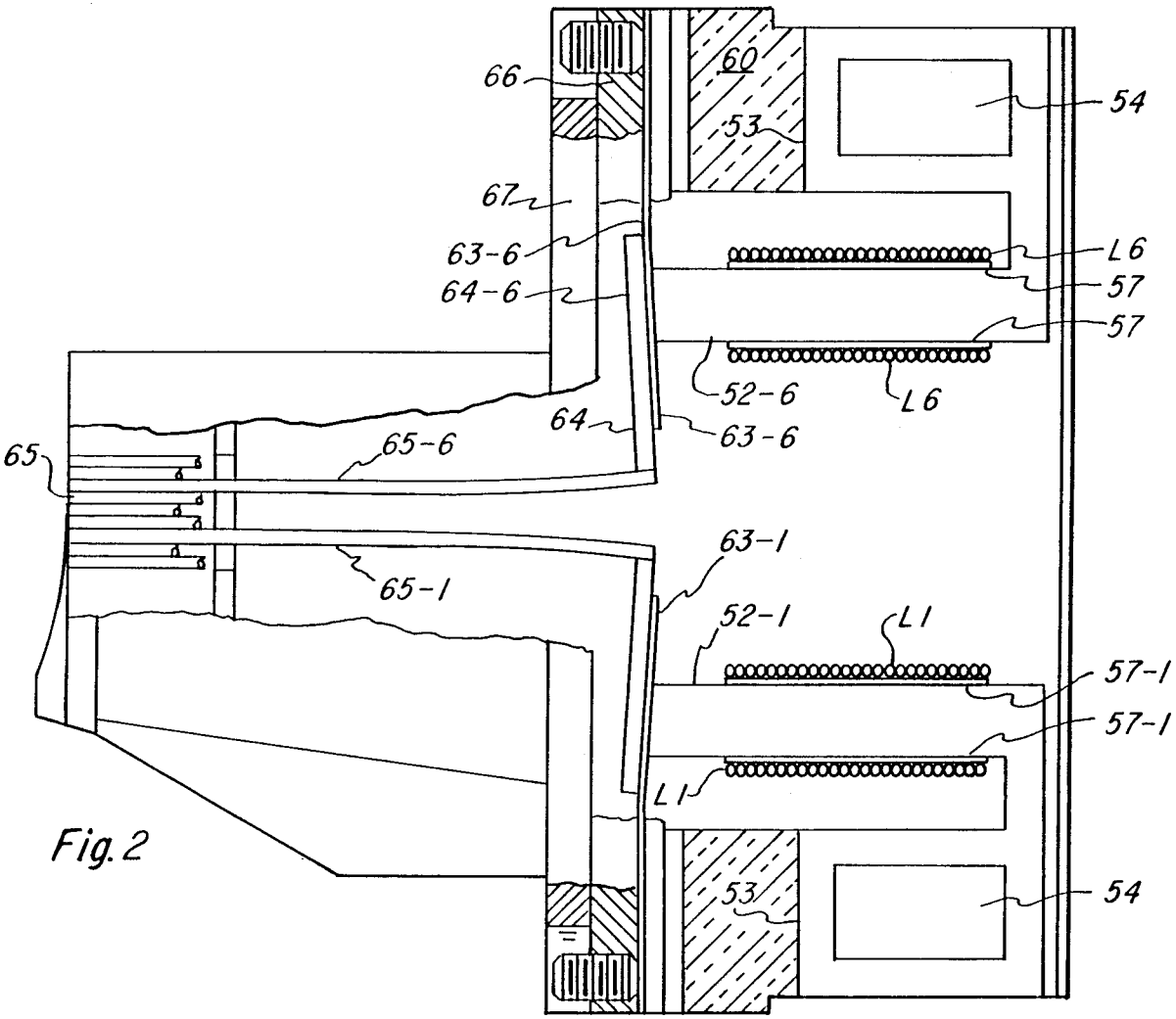
FIG. 2 is a cross section of the printhead.

FIG. 2 is a cross section of the stored energy printhead and illustrates, for the sake of simplicity, only the first and sixth print members and associated coils L1 and L6, respectively. Laminations 52-1 are shown with insulator 57-1 surrounding the laminations and insulating them from print element coil L1. Laminations 52-1 are formed in a U shape with one leg truncated and with an aperture 54 in the truncated leg. Aperture 54 is made for purposes of molding assembly 51 and holding the laminations 52-1 and 52-6 in place. Print members 65-1 and 65-6 are illustrated with their respective springs 63-1 and 63-6, together with the stiffening end flux plates 64-1 and 64-6 in the flexed position.

This invention is implemented by measuring the integral of the voltage applied across the coil to be regulated. The integral of voltage is directly proportional to the flux as shown in equation 1 when the coil resistance is considered to be zero.

$$\Phi = 1/N \int V(t)dt \quad (1)$$

N = number of winding turns
V(t) = voltage applied to coil.
When the resistance of the coil is considered then:

$$\Phi = 1/N \int V(t) - V_R(t)dt \quad (2)$$

$V_R$ = voltage across the coil equivalent resistance.

For large L to R ratios or short integration times, the integration error due to the resistance may be small enough to ignore.

Figure 3:
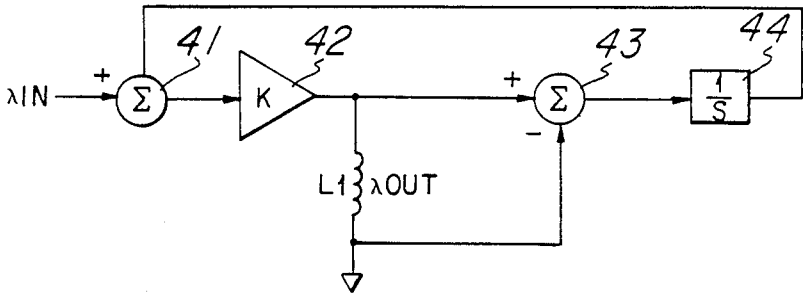
FIG. 3 is a block diagram of the flux regulator of this invention without compensation for coil resistance.

FIG. 3 illustrates coil L1 having summer 43 for measuring its terminal voltage and integrator 44 for integrating that voltage. The output of integrator 44 is fed back to summer 41 whose other input is the reference voltage. The difference between the inputs to summer 41 represents the error signal which is applied to amplifier 42 which supplies power to coil L1. It can therefore be seen that the negative feedback from integrator 44 represents the flux in coil L1 which is then adjusted by the difference generated in summer 41 and applied to amplifier 42.

Figure 4:
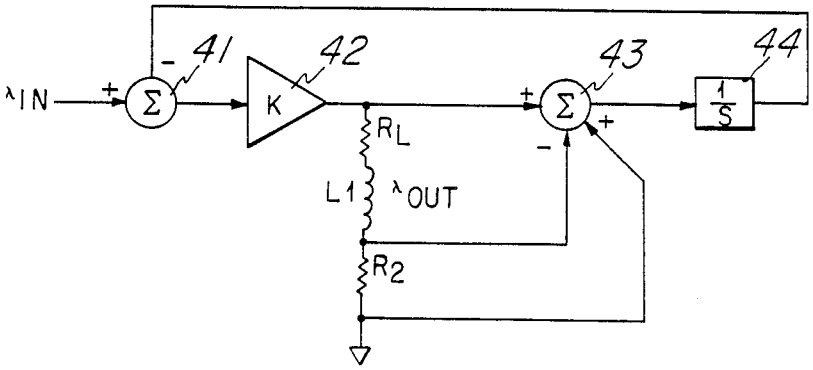
FIG. 4 is a block diagram of the flux regulator of this invention, compensated for coil resistance.

FIG. 4 is the same circuit as FIG. 3 but with the addition of resistor R2 connected between L1 and ground as shown. In one embodiment, resistor R2 is of the same value as the resistance RL of coil L1. In the preferred embodiment, the value of resistance of resistor R2 is scaled, and both resistor R2 and coil L1 voltages are scaled for minimum power dissipation.

Figure 5:
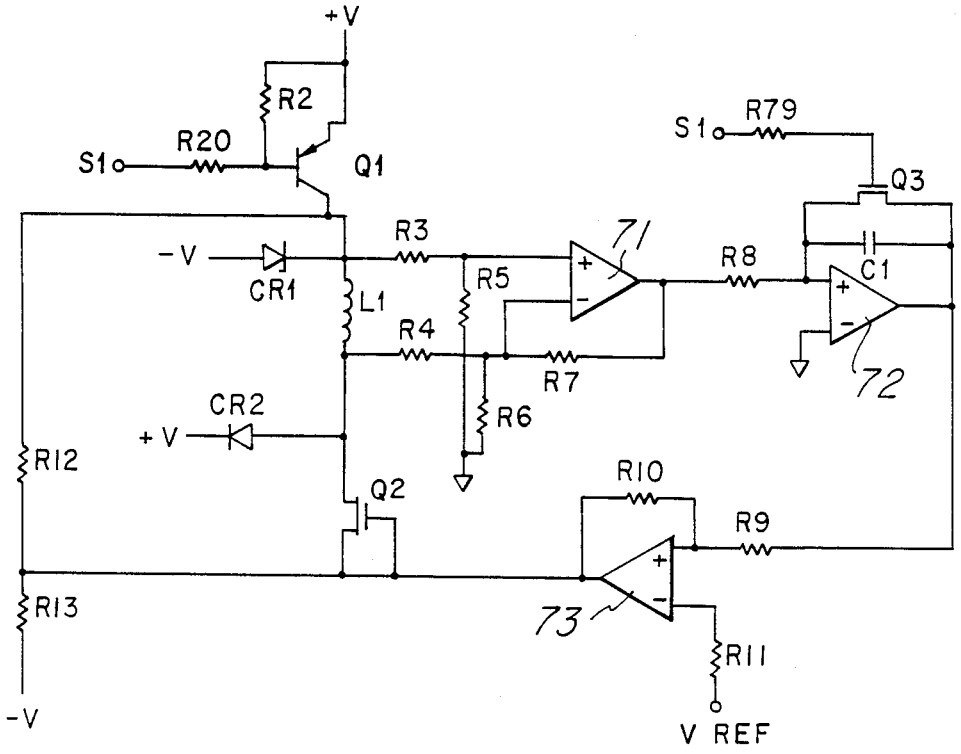
FIG. 5 is a schematic diagram of the flux regulator of this invention without compensation for the coil resistance.

FIG. 5 is a schematic diagram of FIG. 3. Operational amplifier 71, together with associated resistors R3–R7 form summer 43 of FIG. 3 (and FIG. 4). Resistors R3 and R4 are shown with one end of each connected to opposite sides of printhead coil L1, with the other end of resistor R3 connected to the positive input of operational amplifier 71, and the other end of resistor R4 being connected to the negative input to op amp 71. The other end of resistor R3 is also connected to ground through resistor R5. The other end of resistor R4 is also connected to ground through resistor R6. Amplifier 42 of FIG. 3 is implemented in FIG. 5 as transistor Q1 and its associated components. Transistor Q1 has its emitter connected to voltage +V and also to one end of resistor R2 whose other end is connected to the base of transistor Q1. The base of transistor Q1 is tied to logic signal "S1" through resistor R20. The collector of transistor Q1 is connected to the junction of coil L1 and one end of resistor R3. That juncture is connected through diode CR1 to voltage −V. Diode CR2 connects the other end of coil L1 to +V. Transistor Q2 has its source connected to the other end of coil L1 and its drain connected to voltage −V, with its base connected to the junction between the one ends of resistors R12 and R13. The other end of resistor 13 is connected to −V and the other end of resistor R12 is connected to the one end of resistor R3 and coil L1.

Integrator 44 is made up of operational amplifier 72 which has its negative input grounded and its positive input connected through resistor R8 to the output of operational amplifier 71. The positive input of operational amplifier 72 is also connected to integrating capacitor C1 whose other terminal is connected to the output of operational amplifier 72. Transistor Q3 is connected as shown to discharge capacitor C1 and to shut off the discharge when logic signal S1 is applied to its gate, as shown.

Summer 41 is made up of operational amplifier 73 and resistors R9–R11. Resistor R9 is connected at one end to the output of operational amplifier 72 and at the other end to the positive input to operational amplifier 73. Resistor R10 is connected between the output of operational amplifier 73 and its positive input. Resistor R11 is connected to the negative input of operational amplifier 73 at one end and to the reference voltage at the other end. The output of summer 41 is connected to the input amplifier 42, between the junction of resistors R12 and R13 as shown.

The above circuit is formed into the component parts shown in FIG. 3 in a straightforward, well known manner. To arrive at the coil resistance compensated circuit of FIG. 4, it would be necessary to add resistance to the other end of coil L1 in FIG. 5, scaling the resistance value and the voltages across coil L1 and resistor R2.

The desired flux is determined through the use of equation 1 or equation 2. Once that desired flux has been determined, then the reference voltage, proportional to that desired flux is set and the circuit of FIG. 5 will enable the instantaneous flux regulation of coil L1.

Turning now to FIGS. 6A–6D, the invention is shown as implemented in a semiconductor chip.

In the description that follows, it should be noted that the following designations apply:

VEE = −30 volts
VCC = +30 volts
2VBEN = 1.4 volts
3VBEN = 2.1 volts
Substrate ground is connected to VEE.

Figure 6A:
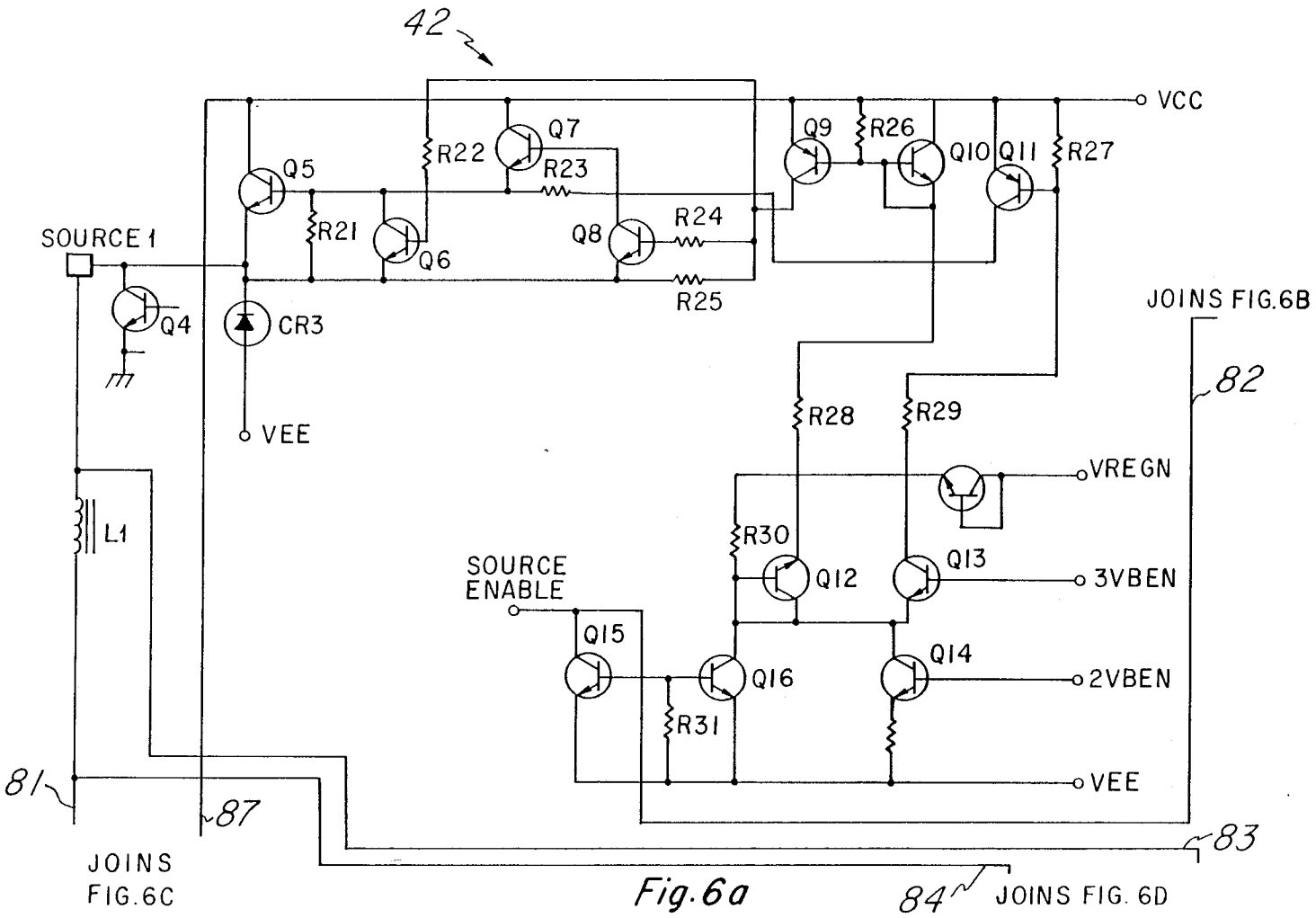
FIGS. 6A–6D form a schematic diagram of the preferred embodiment of this invention, as implemented.

More specifically, FIG. 6A illustrates the coil L1 connected to be driven by amplifier 42. Transistors Q4–Q11 and their accompanying resistors R21–R27 form a power switching network, as shown, for driving current into inductor L1. Transistors Q12–Q16 and associated resistors R30–R32, as shown, form a predrive transistor for driving the power switching network.

Figure 6B:
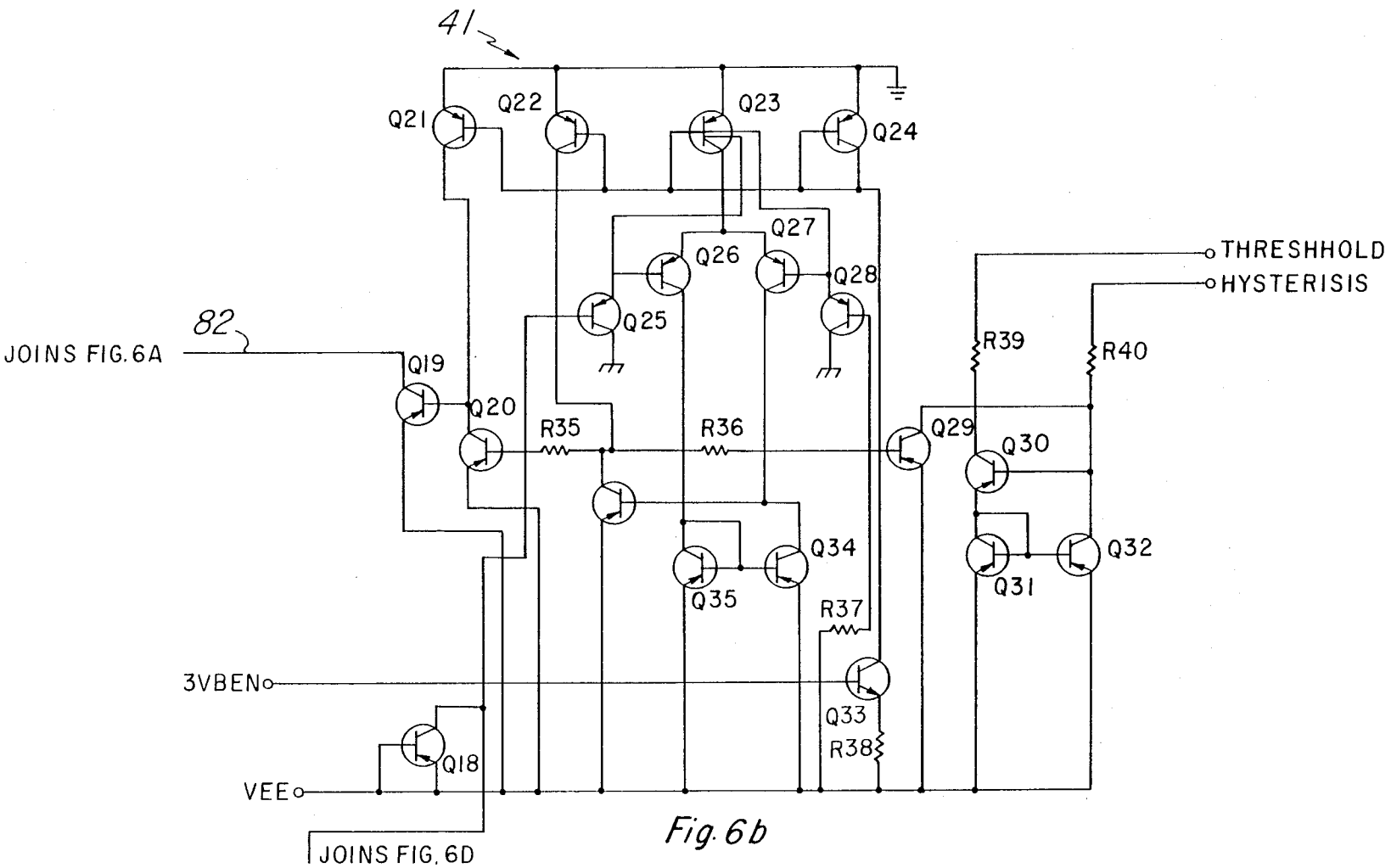

FIG. 6B illustrates comparator 41A. In FIG. 3 and FIG. 4, a summer 41 is shown. A summer connotes a linear circuit while the comparator 41A connotes a switching circuit. The selection is obviously an engineering choice. The comparator 41A is a conventional design and is connected as shown.

Figure 6C:
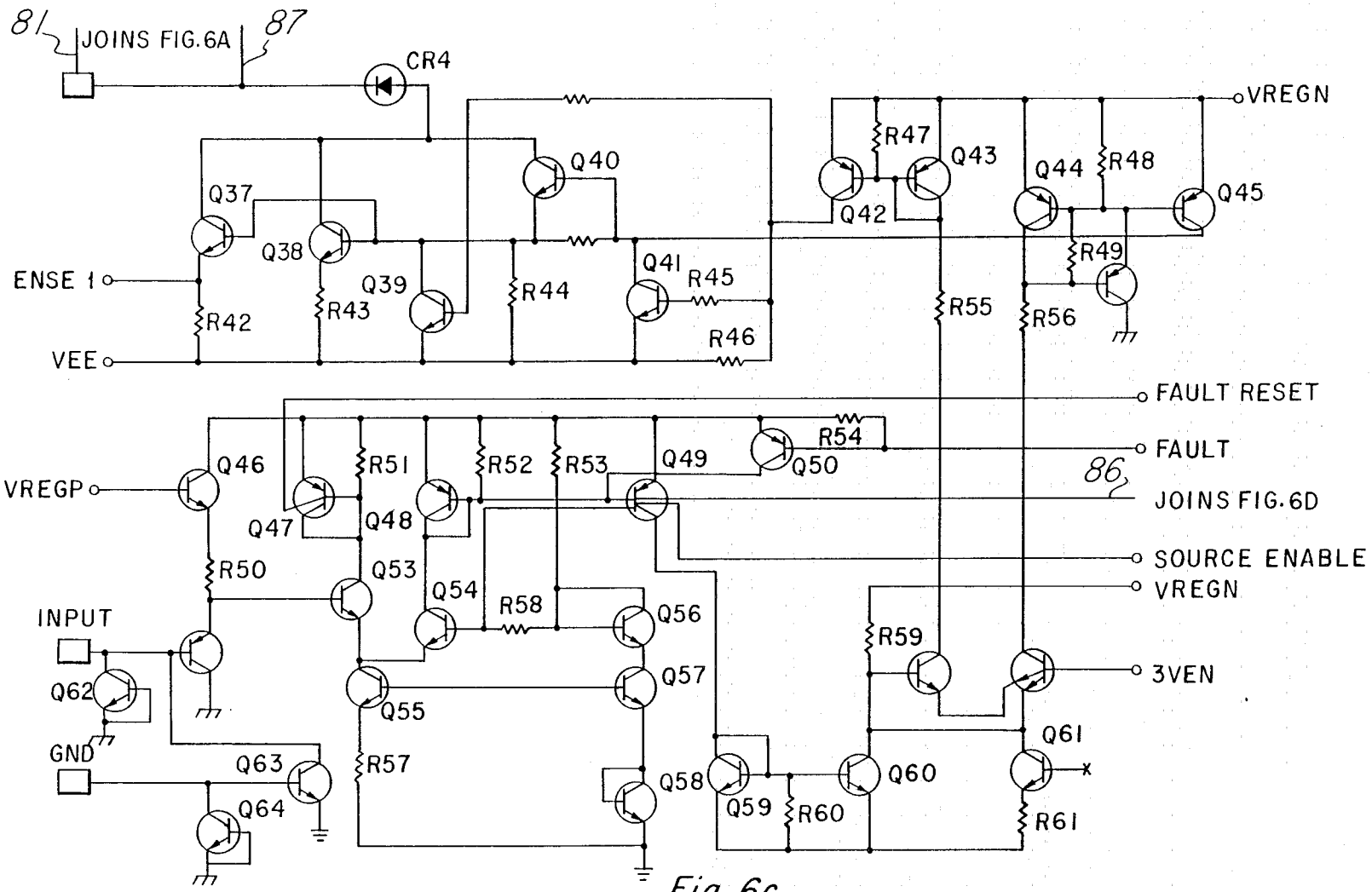

FIG. 6C is a circuit that is not absolutely required for the operation of this invention. However, it is useful for providing a voltage level translation and it is primarily useful for recovering energy when the coil L1 is turned off. The output from transitors Q51 and Q52 are used to turn on the circuit formed by transitors Q37–Q45, which forms a power transistor-like network. The invention would work with the one end of coil L1 grounded instead of terminating in the circuitry of FIG. 6C. However, the operation is greatly enhanced by using this circuitry.

Figure 6D:
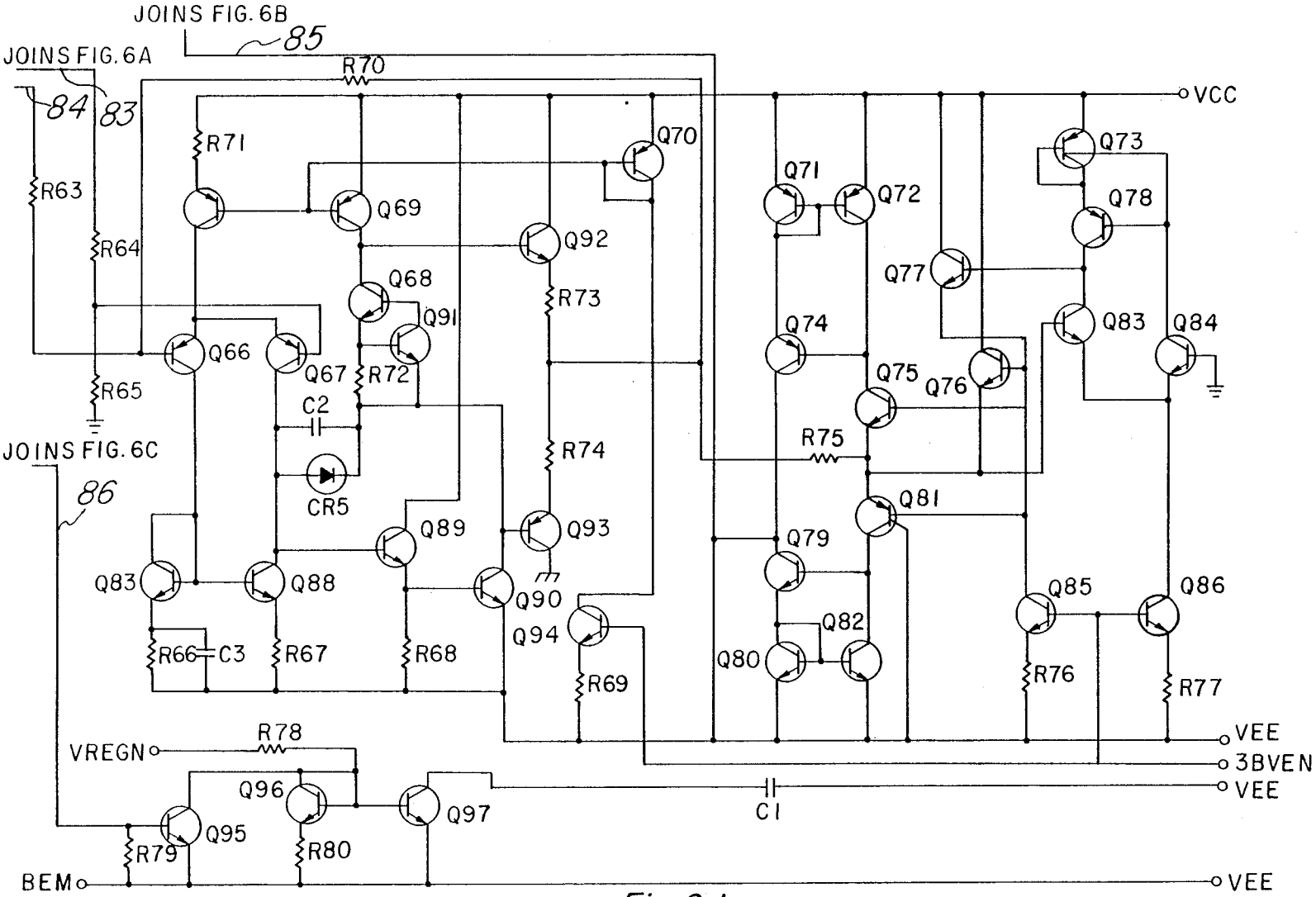

FIG. 6D illustrates summer 43 and integrator 44. Integrator 44 is made up of transistors Q71–Q86 and associated resistors R74–R77, connected as shown. This integrator linearly charges and discharges capacitor C1 as determined by its input voltage from a differential amplifier 43. The circuit formed by transistors Q95–Q97 and associated resistors R78–R80, connected as shown, is a capacitor reset circuit, so that capacitor C1 is permitted to charge or not. The reset circuit's main function is to initialize the integrator.

This circuit could also incorporate the resistance of inductor L1 as shown in FIG. 4, when a particular circuit use requires such treatment.

PREFERRED MODE OF OPERATION

The desired flux in inductor L1 is first calculated using equation 1 or equation 2, depending upon the circuit to be implemented. The flux is expressed as a voltage level and is applied to the threshold terminal of FIG. 6B. With the reference voltage in place, printer 10 of FIG. 1 is ready for use. The coils L1–L6 are energized as required to form desired letters and characters. The formation of such letters and characters may require overlapping coil activation wherein the fields created interfere with each other requiring immediate compensation for those coils that are adversely affected. With reference to FIGS. 6A–6D which illustrate the preferred imbodiment of this invention, amplifier 62 is shown supplying power to coil L1, a single coil of the printhead 11. This coil could, of course, be a motor coil, a solenoid coil, or any other coil where flux regulation is critical.

Coil L1, shown in FIG. 6A, has its voltage measured by operational amplifier 43, shown in FIG. 6D, whose output is integrated through integrator 44. The output of integrator 44 is fed back to the input of comparator 41A on line 85 where it is compared with the reference voltage on the threshold input shown in FIG. 6B. The output from comparator 41A is applied to the predriver circuit of FIG. 6A which drives the power transitor network which then provides power to coil L1. If the flux in the coil L1 is higher than the reference, then amplifier 42 supplies less power to coil L1. If the flux measured is lower than the reference voltage, then more power is applied to coil L1.

By continually monitoring the flux in the coil, and continually comparing the flux with a reference, instantaneous changes can be made to maintain the flux at the desired level. This enables proper operation of coils in the printhead 11 as shown, or in other applications as noted.

It is contemplated that those familiar with the art may make changes to the specific circuits that achieve the desired results as shown without departing from the spirit and scope of this invention which is limited only by the appended claims.

We claim:

1. An impact printer comprising:

(a) a printhead, mounted in the printer, having a plurality of print members and a plurality of selectively actuable coils, each coil associated with one of the plurality of print members for driving the associated member into contact with a print medium; and (b) flux regulator means, connected to the plurality of coils, comprising, integrating means connected across each coil to yield a voltage directly proportional to the magnetic flux present in each coil for providing a parametric representation of the magnetic fluix present in each coil, reference means for providing a parametric representation of the magnetic flux desired in each coil;

error signal means for comparing the representation of the flux present with the representation of the flux desired and providing an error signal representative of the difference therebetween; and power means, receptive to the error signal means, for selectively changing the power to each coil to adjust the flux therein as determined by the error signal.

2. The regulator of claim 1 wherein the integrating means comprises an operational amplifier.

3. The regulator of claim 1 wherein the reference means comprises a voltage directly proportional to the magnetic flux desired in each coil.

4. The regulator of claim 3 wherein the error signal means comprises comparator means for comparing the voltage directly proportional to the magnetic flux present in each coil with the voltage directly proportional to the magnetic flux desired in each coil.

5. The regulator of claim 4 wherein the comparator means comprises an operational amplifier.

6. The regulator of claim 4 wherein the power means comprises an amplifier.

* * * * *